US011046395B2

(12) United States Patent
Prins

(10) Patent No.: US 11,046,395 B2
(45) Date of Patent: Jun. 29, 2021

(54) VESSEL WITH TRANSFER INSTALLATION FOR TRANSFERRING PERSONS AND CARGO FROM THE VESSEL TOWARDS AN OFFSHORE CONSTRUCTION

(71) Applicant: Z BRIDGE B.V.

(72) Inventor: Reinout Klaar Norfolc Jaap Prins, Assendelft (NL)

(73) Assignee: Z BRIDGE B.V, Ijmuiden (NL)

( * ) Notice: Subject to any disclaimer, the term of this patent is extended or adjusted under 35 U.S.C. 154(b) by 74 days.

(21) Appl. No.: 16/499,929

(22) PCT Filed: Mar. 29, 2018

(86) PCT No.: PCT/NL2018/050193
§ 371 (c)(1),
(2) Date: Oct. 1, 2019

(87) PCT Pub. No.: WO2018/186737
PCT Pub. Date: Oct. 11, 2018

(65) Prior Publication Data

US 2021/0107599 A1 Apr. 15, 2021

(30) Foreign Application Priority Data

Apr. 6, 2017 (NL) ..... 1042334

(51) Int. Cl.
*B63B 27/30* (2006.01)
*B63B 27/14* (2006.01)
*B63B 21/50* (2006.01)

(52) U.S. Cl.
CPC ..... *B63B 27/30* (2013.01); *B63B 21/50* (2013.01); *B63B 27/146* (2013.01); *B63B 2021/505* (2013.01); *B63B 2027/141* (2013.01)

(58) Field of Classification Search
CPC ..... B63B 27/30; B63B 21/50; B63B 27/146; B63B 2021/505; B63B 2027/141; B63B 27/14
See application file for complete search history.

(56) References Cited

U.S. PATENT DOCUMENTS 4,473,916 A * 10/1984 Connold ..... B63B 27/14 14/42
10,486,775 B2 * 11/2019 Nostvold ..... B63B 27/30
(Continued)

FOREIGN PATENT DOCUMENTS

EP 2757034 A1 7/2014
IT 1246074 B 11/1994
(Continued)

OTHER PUBLICATIONS

Written Opinion Of The International Searching Authority issued by the European Patent Office in relation to International Application No. PCT/NL2018/050193 dated Jul. 2, 2018 (Year: 2018).*

*Primary Examiner* — Anthony D Wiest
(74) *Attorney, Agent, or Firm* — Browdy and Neimark, PLLC

(57) ABSTRACT

A vessel (1) with a transfer installation for cargo and persons towards an offshore construction (12) comprises means for stabilizing its position at sea relative to the offshore construction (12), a telescopically extendable beam assembly (2) that comprises telescopable beam elements (2*a*, 2*b*), which beam assembly (2) with its one outer end (15) is rotatably connected to the vessel (1) by means of an axle system (7*a*, 8*a*, 9*a*), and a driving device designed to bring the other outer end (16) of the telescopically extendable beam assembly (2) in contact with a landing provision (13) of the offshore construction (12). The telescopically extendable beam assembly (2) is provided with means for moving a transportation carriage (14) back and forth between both
(Continued)

outer ends (15, 16) along the telescopically extendable beam assembly (2), wherein the transportation carriage (14) is provided with a support (20) for carrying the cargo and persons.

15 Claims, 10 Drawing Sheets

(56) References Cited

U.S. PATENT DOCUMENTS

| | | | | |
|---|---|---|---|---|
| 2009/0050045 | A1* | 2/2009 | Grimaldi | B63B 27/14<br>114/362 |
| 2013/0255012 | A1 | 10/2013 | Prins | |
| 2015/0121635 | A1* | 5/2015 | Prins | B63B 27/30<br>14/71.1 |

FOREIGN PATENT DOCUMENTS

| | | | | |
|---|---|---|---|---|
| JP | 07251791 | A * | 10/1995 | |
| WO | 2002020343 | A1 | 3/2002 | |
| WO | 2011019289 | A1 | 2/2011 | |
| WO | WO-2012138227 | A1 * | 10/2012 | B63B 27/30 |
| WO | 2013180564 | A1 | 12/2013 | |
| WO | 2014077694 | A1 | 5/2014 | |
| WO | WO-2016116688 | A1 * | 7/2016 | B63B 27/30 |

* cited by examiner

VESSEL WITH TRANSFER INSTALLATION FOR TRANSFERRING PERSONS AND CARGO FROM THE VESSEL TOWARDS AN OFFSHORE CONSTRUCTION

The invention relates to a vessel that, for the transport and transfer of persons and cargo towards and from offshore constructions, in particular ones that are founded to the bottom of the sea, like wind turbines and installations for the winning of oil and gas, are provided with an installation comprising a beam assembly, that at one end is rotatably connected to a vessel by means of an axle system and that is provided with driving means with which the other end of the beam assembly is movable for making contact with the offshore construction and maintaining this contact independent of movements of the vessel. For compensating the relative movements between the lively floating vessel and the stationary offshore construction, the beam assembly is composed of plural beam elements which along their longitudinal axis are telescopable such that the distance between their outer ends is variable.

A bridging installation is known from several patents (amongst which OAS WO-0220343; Zbridge WO-2013180564) in which the beam assembly, also referred to as gangway, is provided with means for letting people walk the distance between the vessel and the offshore construction over the beam elements. Since the distance is crossed walking, the angle of the walking surface on the beam elements relative to the horizontal is limited to security rules and practical objections. Because of the relative movement of the support construction on the vessel relative to the stationary offshore construction, the beam assembly in said patents comprises telescoping elements to compensate for this movement, which limits the usability of said construction as carrier of a walking provision.

In order to keep the angle relative to the horizontal face, within which the walking provision on the beam assembly must stay in order to be usable in practice and to comply with legal demands, one is often forced to mount large and heavy support constructions on the vessel, with the aim to be able to make contact with the offshore construction at a desired level, including at relative high levels such that the angle of inclination of the walking surface relative to the horizontal can remain as close as possible to this horizontal. Persons and cargo then need to be brought to the desired level in order to gain access to the beginning of the gangway via for example a lift that is guided through the interior or along the outside of an upright column of the support construction. Despite the provision of such a lift, it can still be quite difficult and exhausting for persons to walk over the gangway itself, particularly if its angle of inclination becomes relative steep and/or if a lot of cargo needs to be taken along and/or if weather conditions are harsh with lots of wind and high waves.

With this it is noted that normally a gangway is classified as a ramp for which the maximum operational angle amplitude/range to the horizontal for the gangway shall be ±10 degrees. Up to 20 degrees may be used if the gangway is fitted with enhanced slip resistance features. Steeper operational angles may only be considered provided that the deck of the gangway is fitted with treads or steps. As soon as it is detected that the angle gets larger than a $1^{st}$ threshold value, then a level 1 alarm gets triggered and transfer of persons is no longer allowed, whereas personnel on the gangway must evacuate. In case it is detected that the angle even gets larger than a $2^{nd}$ threshold value, then a level 2 alarm gets triggered and disconnection of the gangway takes place.

Furthermore the fact that the gangway might be telescoping in and out in order to maintain permanent contact with for example a landing platform that is mounted to the offshore construction, is considered fearful by some people, particularly if the telescoping takes place at high speed because of compensation that needs to take place for all vessel movements during rough seas and the like. Further it is remarked that the bridging installation with its high and heavy support construction is not only expensive and complex to manufacture, but is also truly large and heavy. In fact the entire bridging installation may even weigh more than 50 tons. This makes it totally unsuitable for use on a smaller vessel like for example a Crew Transfer Vessel (CTV).

Such CTV's are lightweight, for example made from aluminium, such that they can sail and manoeuvre at high speeds. For such CTV's it is nowadays common practice to have them sail against two spaced apart bumpers that are mounted on the offshore construction, like a mast of an offshore wind turbine. Subsequently a person needs to step from an upper deck of the CTV onto a ladder that is also mounted on the offshore construction and that has its lower end starting at a distance behind centrally in between the bumpers. Subsequently the person can climb the ladder until he reaches a landing platform on the offshore construction.

A disadvantage hereof is that climbing the ladder towards the landing platform, that mostly is provided at levels of more than 15 meters above sea level, is quite difficult and exhausting for persons, particularly if weather conditions are harsh with lots of wind. Furthermore, the stepping over onto the ladder is a truly dangerous operation, particularly if weather conditions are such harsh with lots of wind and high waves that the CTV runs the risk to all of a sudden start sliding up and down along the bumpers. The person then might even be forced to all of a sudden make a big jump towards the ladder and immediately start climbing upwards. For that reason the person is obliged to wear a survival suit for the case he should accidentally fall into the sea. According to recent regulations the person also is no longer allowed to take along any cargo, not even a backpack. All cargo must be transferred between the vessel and the offshore construction in another manner, for example by means of a hoist.

It is known to provide a gripper at the front of the CTV that is designed to fixedly grip the bumpers in particular at upper portions thereof that correspond to heights of wave peaks occurring at that moment. Thus it is aimed to prevent the CTV from starting to slide up and down along the bumpers during transfer of the persons between the CTV and the ladder. This gripper however adds a lot of weight to the front side of the CTV and is not strong or safe enough to fulfil its purpose under all wind-forces. Besides that it is noted that the fixed gripping of upper portions of the bumpers has the effect of waves constantly causing the CTV to hinge around its gripper and changing its angle.

The present invention aims to overcome those disadvantages at least partly or to provide a usable alternative. In particular the invention aims to provide a small vessel like a CTV with a safe, user-friendly, small and lightweight transfer construction for persons and cargo.

This aim is achieved by a vessel according to claim 1. The vessel comprises means for stabilizing its position at sea relative to the offshore construction. Furthermore the vessel is equipped with a transfer installation for the transport and transfer of cargo and persons towards an offshore construction, that in particular is founded to the bottom of the sea. The transfer installation comprises a telescopically extendable beam assembly that comprises two or more beam elements, which along their longitudinal axis are telescopable such that a distance between their outer ends is variable. The beam assembly is rotatably connected with a proximal first one of the outer ends to the vessel by means of an axle system. A driving device is provided that is designed to bring a distal second one of the outer ends of the telescopically extendable beam assembly in contact with a landing provision of the offshore construction. According to the inventive thought the telescopically extendable beam assembly is provided with means for moving a transportation carriage back and forth between both outer ends along the telescopically extendable beam assembly, wherein the transportation carriage is provided with a support for carrying the cargo and persons.

According to the invention, persons and cargo now advantageously get moved by means of the carriage along the beam elements between the vessel and the offshore construction, owing to which the described angle limitation relative to the horizontal of the walking surface on the beam element, is settled since the persons in the carriage have the opportunity to cover the distance while standing still or in a sitting position.

Persons and cargo can simply take place or get placed on the carriage support and then get moved to the landing provision, like a landing platform. They no longer have to walk by themselves over the beam assembly. The angle of inclination during operation now can be quite steep, and at least be larger than the abovementioned maximum allowed 15/20 degrees for state of the art gangways. in particular this angle during operation may even get to be as large as 60 or 70 degrees. The only thing that is important is that the persons and cargo do not get to slide of the carriage support during moving of the carriage over and along the beam assembly. The transfer installation according to the invention advantageously is well able to overcome height and distance in an integrated manner. By bringing in position an inclined beam assembly between the vessel and the offshore construction, the carriage can directly be moved slanting up and down from the vessel's deck towards the landing platform and vice versa. This makes it possible to transfer persons and cargo quicker, safer and more flexible with smaller vessels.

During operation, the proximal end of the beam assembly advantageously can remain substantially on the level of the vessel's upper deck, while the driving device brings the distal outer end of the beam assembly in contact with the landing provision. For the carriage it makes no difference if the angle of inclination of the beam assembly along which it gets moved becomes relative steep and/or is quickly changing and/or if a lot of cargo needs to be taken along and/or if weather conditions are harsh with lots of wind and high waves. Furthermore the fact that the gangway might be telescoping in and out in order to maintain permanent contact with the landing provision makes no difference for the people inside the carriage, not even if the telescoping takes place at high speed because of quickly changing wave heights for which compensation is required.

The transfer installation according to the invention can be kept relative lightweight, compact and inexpensive. Thus it is well suitable to be mounted onto for example a CTV. During operation the CTV then can still be sailed against two spaced apart bumpers that are mounted on the offshore construction, after which the distal end of the beam assembly can quickly and reliably be manoeuvred towards the landing provision. In the alternative it is also possible to have the CTV or other type of vessel be provided with other means for stabilizing its position at sea relative to the offshore construction, like for example a dynamic positioning system which is designed to have the vessel substantially maintain its position on open sea. In the alternative it is also possible to temporarily anchor the vessel. In those alternatives it is then also possible to have the distal end of the beam assembly quickly and reliably manoeuvred towards the landing provision.

Subsequently a person only needs to step from the CTV onto the carriage support and get himself moved over and along the beam assembly towards the landing platform or the like. There he can get of the carriage support and step onto the landing platform. This is a truly easy and safe action that is suitable for all persons, including those who are not fully fit or less strong. The same goes for the transfer of cargo. There is no risk of the person dropping into the water and therefore he does not have to wear a survival suit.

Advantageously it is no longer a problem if weather conditions are such harsh with lots of wind and high waves that the CTV runs the risk to all of a sudden start sliding up and down alongside the bumpers. The beam assembly can easily and quickly compensate for such up and down sliding movements by suitable rotations of the beam assembly around one or more axles of its axle system in combination with suitable telescoping extensions or retractions of the beam assembly.

In an advantageous embodiment the telescopically extendable beam assembly can be provided with drive means and control provisions for maintaining permanent contact with the offshore construction independent of vessel movement. Such drive means and control provisions in particular can be designed for having the distal end of the beam assembly constantly exert a minimum pushing force against the landing provision for as long as contact is desired between them. This makes it possible to quickly and safely dock the distal end of the beam assembly against an aimed portion of the landing provision. In the alternative it is also possible to provide an operable coupling between the distal end of the beam assembly and the landing provision.

In a preferred embodiment the carriage is subdividable in distinctive carriage parts that each for themselves are adapted to the design and dimensions of each separate beam element. The carriage assembly, because getting carried per beam element by a carriage part that is adapted to this beam element, can displace itself between both beam assembly ends without the movements of the distinctive beam elements telescoping into and out of each other being of influence to this. Thus a more smooth moving of the carriage along the beam assembly has become possible. The dynamic transition between the telescoping beam elements is deemed to have less or even no influence at all on the moving of the carriage along the beam assembly.

One of the carriage parts then can be provided with the support for carrying the cargo and persons. Furthermore, the one carriage part can be movably guided along the one beam element, wherein the other carriage part can be movably guided along the other beam element.

The one carriage part then can be movable along the one beam element towards and automatically connectable with the other carriage part that is ready and waiting at the transition between the telescoping beam elements for, as soon as the one and the other carriage part are connected with each other, together being further movable along the other beam element towards one of the outer ends of the beam assembly. In the alternative it is also possible to have the support being taken over from the one carriage part by the other carriage part and vice versa at the location of the transition between the telescoping beam elements.

In an embodiment the means for moving the transportation carriage back and forth between both outer ends of the telescopically extendable beam assembly comprise a drive system that is designed to move the carriage and/or their respective carriage parts along the beam assembly and/or their respective beam elements.

This drive system preferably comprises one or more controllable motors, like an electromotor. This controllable motor may for example drive a gear/cog wheel that is provided on the carriage or on one of its carriage parts and that acts on a toothed rack/cog railway that is provided along the beam assembly. In a preferred embodiment the drive system may have a controllable winch, cable and reverse pulley.

The drive system may act upon only one of carriage parts, for bringing this carriage part from the one outer end forth towards and in connection with the other carriage part, and for then bringing the one and the other carriage parts together as an assembly further forth towards the other outer end of the beam assembly.

In a further embodiment the transition between the telescoping beam elements forms an automatic stop for one of the carriage parts against further moving towards one of the outer ends of the beam assembly. Thus this carriage part can automatically get to wait at this transition for connection and disconnection with the other carriage part. With this it is possible to bias this carriage part towards the transition and/or have it moved towards the transition under the influence of gravity.

In a preferred embodiment the axle system via which the telescopically extendable beam assembly is connected with its proximal outer end with the vessel, comprises drive means and control means for controlling rotations around individual ones of x-, y- and/or z-axles. In particular it comprises a controllable first driving organ, like a hydraulically operable piston-cylinder, for having the beam assembly rotate around a horizontal axle, orientated rectangular with respect to the orientation of the boom assembly, defined as Y-axle, in order to change its angle of inclination relative to the vessel. This is referred to as luffing. In addition or in the alternative it may comprise a controllable second driving organ, like an operable rotatable pedestal, for having the beam assembly rotate around a vertical z-axle, that is perpendicular to the y-axle, in order to change its rotational position relative to the vessel. This is referred to as slewing. In addition or in the alternative it may comprise a controllable third driving organ, like a hydraulically operable piston-cylinder, for having the beam assembly rotate around a (horizontal) x-axle, that is perpendicular to the y- and z-axle and parallel with the deck which facilitates the system to orientate the earlier mentioned Y-axle always in a horizontal way, irrespective the orientation of the vessel-deck. This is referred to as tilting. Preferably the transportation carriage comprises means for adjusting a position of the support for carrying the cargo and persons relative to the rest of the carriage or carriage parts. Thus it is possible to have the support maintain a substantially constant same orientation relative to the horizontal, that is to say in particular independent of an angle of inclination of the telescopically extendable beam assembly.

The transportation carriage or the carriage parts thereof can be guided along the beam assembly in various manners, like sliding along suitable guide elements. Preferably the carriage or parts thereof can be guided along the beam assembly by means of rollers, preferably rollers that grip around the beam assembly such that the carriage or parts thereof only have a degree of freedom in the longitudinal direction of the beam assembly.

Further preferred embodiments are stated in the dependent subclaims.

The invention further relates to the transfer installation itself for installation on a vessel, as well as to a method for use of the vessel with the transfer installation installed thereupon.

The invention shall be explained below with reference to exemplary embodiments of the invention that are shown in the accompanying drawings, in which:

FIG. 1-4 schematically show a first embodiment of a vessel with transfer installation according to the invention during subsequent phases of the transfer process;

Figure 1:
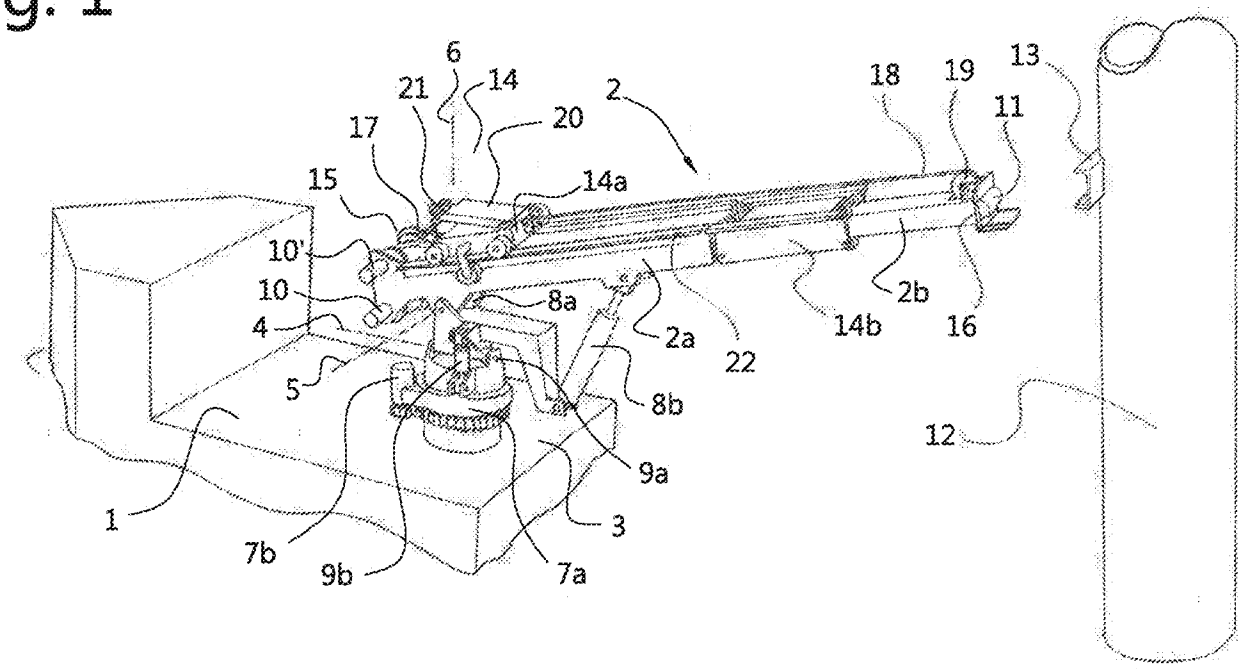

FIG. 1 shows the general assembly of the invention comprising a vessel 1 on which an axle system 7*a*, 8*a*, 9*a* is mounted with which a telescopic bridging beam assembly 2 is connected to the vessel 1.

The axle system 7*a*, 8*a*, 9*a* is included in a supporting construction 3 in which provisions are included for the bearing of respective axles in x-, y- and z-directions 4, 5, 6, in which each axle bearing is provided with controllable drive means for controlled rotation movement of the element that is supported on the bearings, with the aim of having a free distal outer end 16 of the beam assembly 2 move in a controlled manner in space. In the shown embodiment the z-axle 6 rotation is made as slewing bearing 7*a* with drive 7*b*, the y-axle 5 rotation as axle bearing connection 8*a* with cylinder drive 8*b*, and the x-axle 4 rotation as axle bearing connection 9*a* with drive 9*b*.

In the shown embodiment the beam assembly 2 is connected to the axle system 7*a*, 8*a*, 9*a* by means of a connection eye in an x-axle rotation point 9*a*. Other connection points are also possible within the scope of the described invention.

The beam assembly 2 is provided with drive means 10 having control means and integrated guiding provisions for having its respective beam elements 2*a*, 2*b* telescope relative to each other in the longitudinal direction. The free distal outer end 16 of the beam assembly 2 is provided with a contact element 11 that, during contacting with an offshore wind turbine 12 is able to cooperate, if desired, with a landing provision 13 that in occurring cases is applied thereon. The landing provision 13 here comprises a U-profile inside which the contact element 11 can fit with some play.

A transportation carriage 14 is provided on the beam assembly 2 in such a way that it can be transported back and forth towards both outer ends 15 and 16, in which the carriage 14 remains permanently in contact with guiding provisions 22 on the beam assembly 2.

Since the beam assembly 2 comprises two or more beam elements (in the example 2*a* and 2*b*), which are able to telescope into and out of each other, the carriage 14 is split up in a same number of parts 14*a* and 14*b* which are each specifically adapted to the design and dimensions of a respective beam element 2*a*, 2*b*. During a crossing of the distance between the beam's proximal outer end 15 and the beam's distal outer end 16, the first carriage part 14*a*, when passing a transition between the two beam elements 2*a* and 2*b*, in the given example, connects with a second carriage part 14*b*, that specifically is adapted to the design and dimensions of the subsequent beam element 2*b*. During a movement in the opposite direction, the respective second carriage part 14*b* shall, on the contrary, disconnect from the first carriage part 14*a* to give this first carriage part 14*a* the opportunity to properly function as transportation provision that corresponds to the design and dimensions of the beam element 2*a* that in the given direction lies in the continuation of the course in order to take care of the guiding of the carriage part 14*a*.

On the first beam element 2*a* first drive provisions with control means 10 are provided for driving and controlling the movements of the respective telescopic beam elements 2*a*, 2*b* relative to each other. In the example a winch system is shown, but many other means and systems from practice are possible and usable.

Second drive provisions with control means 10' are provided for controlled movement of the carriage 14 over the entire distance between both beam's proximal and distal outer ends 15, 16. In the shown example for this a winch 17, cable 18 and reverse pulley 19 are provided. Other drive means are also possible.

On the transportation carriage part 14*a* adjustment means 21, like a controllable cylinder drive, are provided for being able to adjust a support of the cargo and persons 20 to be transported independent of the angle of orientation of the supporting beam elements 2*a*, 2*b*.

The use of the described invention is not limited to the use of transporting persons and cargo towards and away from stationary constructions placed at sea, but can also be used in every other situation in which persons and cargo need to be transferred or taken over from a vessel towards another body in which both objects are moving relative to each other.

The shown drive means must be seen as examples since many other systems are also possible without affecting the essence of the invention.

Figure 2:
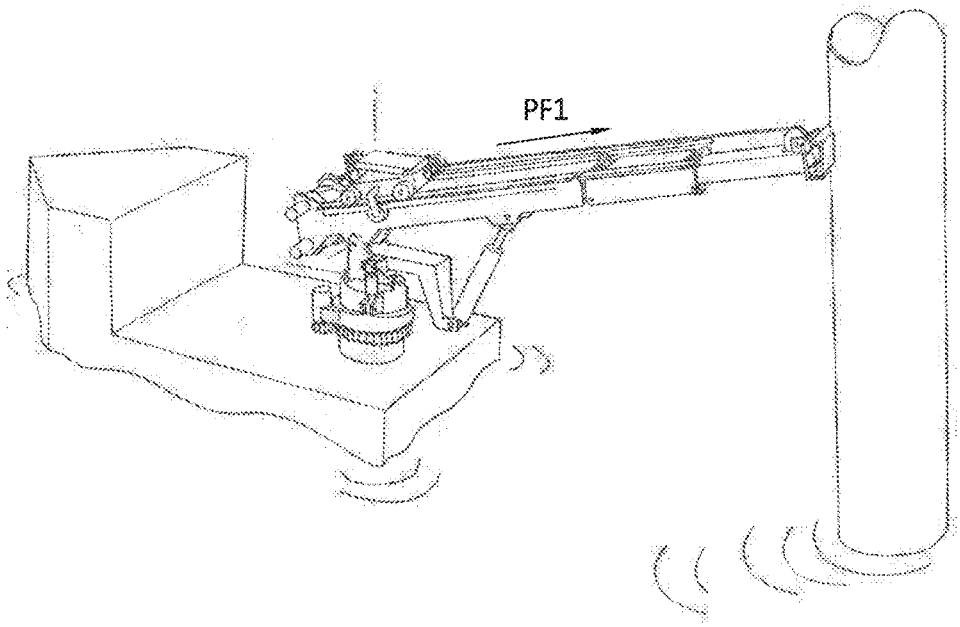

FIG. 2 shows as example the situation in which the contact element 11 on the distal outer end 16 of the beam assembly 2 is brought into contact with the landing provision 13 on the wind turbine 12.

Figure 3:
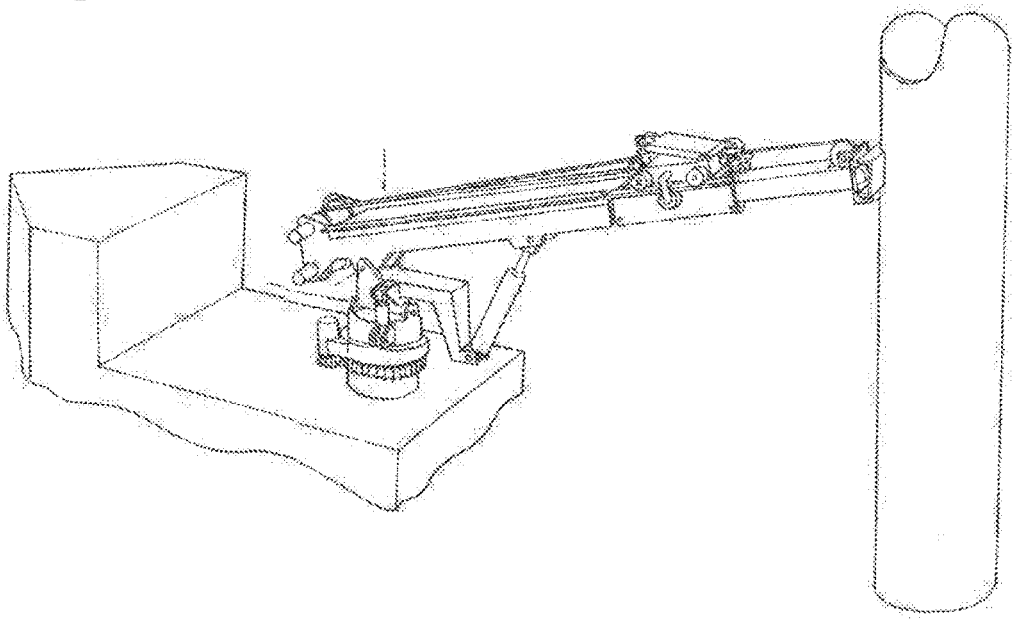

FIG. 3 shows as example the situation in which the first carriage part 14*a*, after having been brought towards the respective position by means of the drive system 17, 18, 19, that has been installed for that purpose, has connected itself with the second carriage part 14*b* for together forming the assembled transportation carriage 14. In the case of a plurality of beam elements and a plurality of respective carriage parts, the assembled transportation carriage 14 shall comprise a corresponding number of carriage elements.

Figure 4:
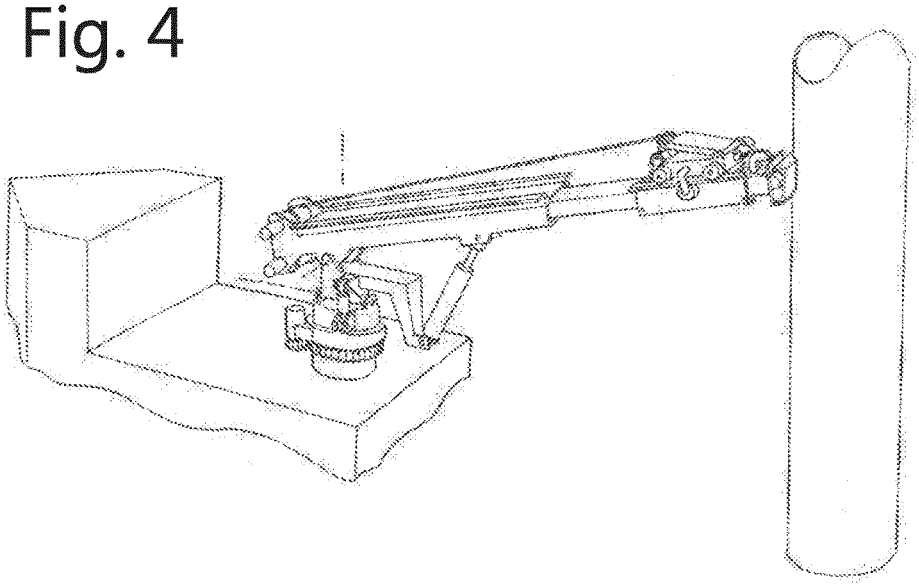

FIG. 4 shows the situation in which the transportation carriage 14 has been brought by the drive system 17, 18, 19, that has been installed for that purpose, towards the outer end 16 of the beam assembly 2. See also FIG. 16.

A movement in the opposite direction of the beam's distal outer end 16 towards the beam's proximal outer end 15 takes place along the same principles but then in the opposite order.

In the embodiment as shown in FIG. 1-4 the vessel 1 is provided with a dynamic positioning system which is designed to have the vessel 1 substantially maintain its position at sea relative to the wind turbine 12. The first drive provisions with control means 10 then can be driven and controlled such that the distal outer end 16 of the beam assembly 2 constantly has a tendency to telescopingly extend and thus maintain a slanting upwards directed pushing force PF1 against the landing provision 12. The second beam element 2*b* of the beam assembly 2 then as it were gets pre-tensioned like a spring to try to slide out of the first beam element 2*a* in the direction of the landing provision 12. This force gets counteracted by the vessel 1 getting substantially kept in place by means of the dynamical positioning system. Thus a permanent pre-tensioned contact can be obtained between the beam assembly 2 of the transfer installation and the landing provision 12 of the wind turbine 13, which pre-tension still makes it possible for the beam assembly 2 to retract and extend as soon as this is necessary for compensations of movements of the vessel 1 relative to the wind turbine 13, like up and down movements with the waves as well as heave, roll and pitch movements that the vessel has to undergo despite its being dynamically positioned.

Figure 5:
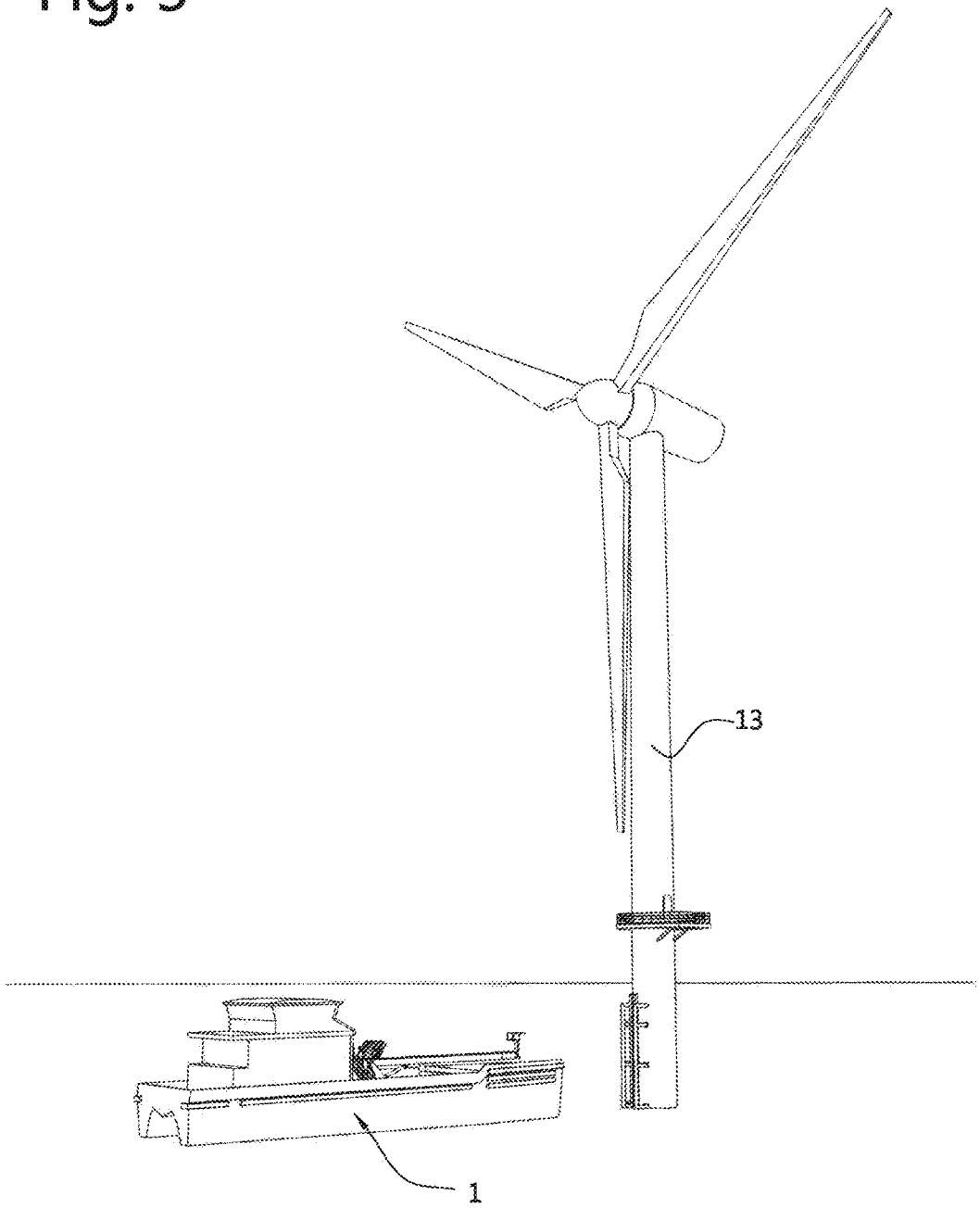
FIG. 5-11 shows a second embodiment during subsequent phases of the transfer process.
Figure 6:
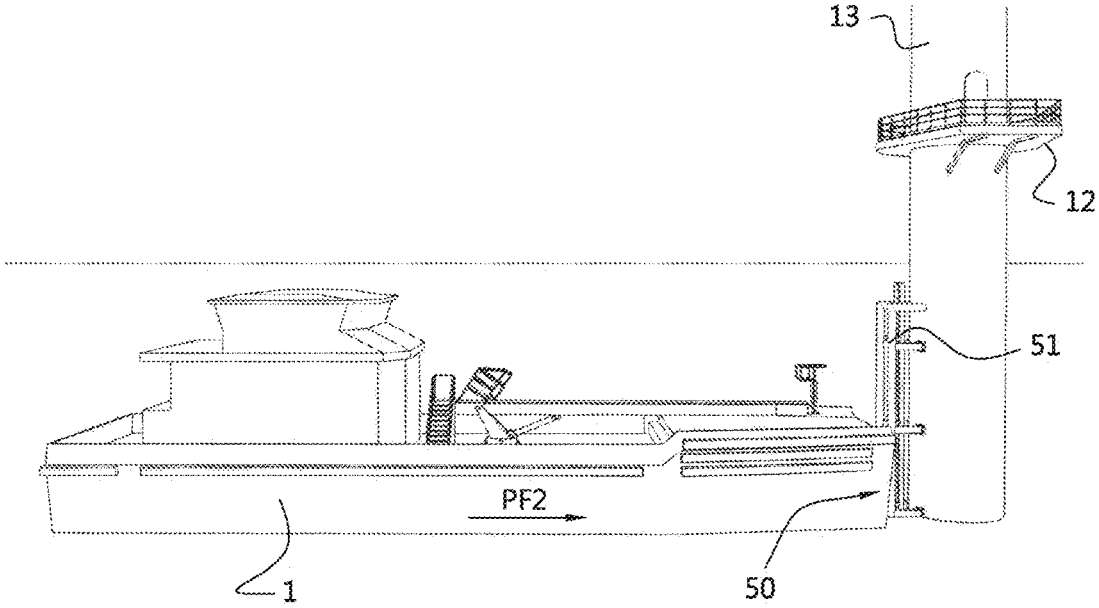

In FIG. 5 a CTV-type of vessel 1 with a similar type of transfer installation is shown as in FIG. 1-4. Similar components have therefore been given same reference numerals. The CTV-type of vessel 1 has a bow 50 that is specifically designed to get landed against two spaced apart bumpers 51 that are mounted on the wind turbine 12. This is shown in FIG. 6. A motor of the vessel 1 can then be operated to have the bow 50 constantly exerting a forward directed pushing force PF2 against the bumpers 51, irrespective of waves, wind and the like acting upon the vessel 1.

Figure 7:
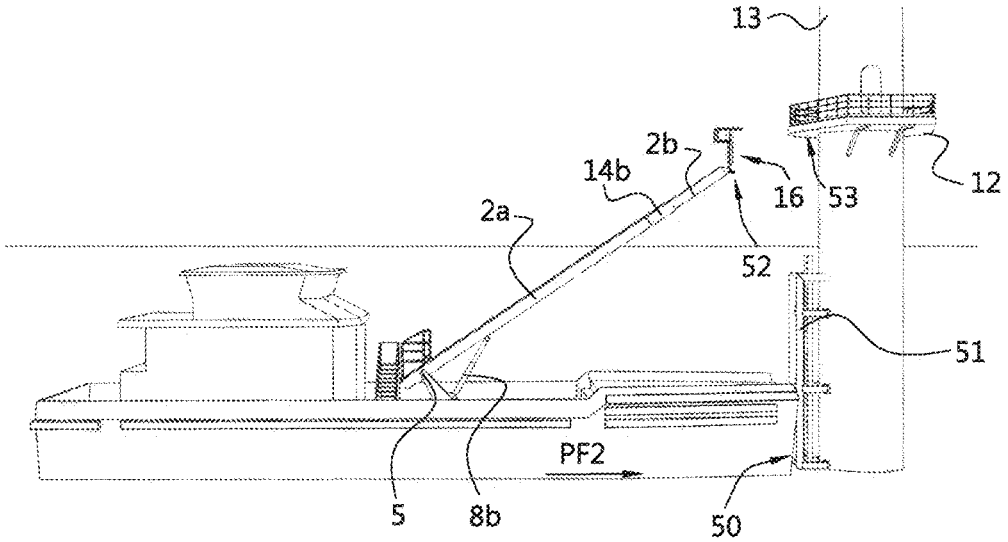

Subsequently the distal end 16 of the beam assembly 2 can be pointed towards the landing provision 13, here formed by a landing platform, by having the beam assembly 2 rotate around its y-axle 5 by means of the hydraulically operable luffing piston-cylinder drive 8*b*. This is shown in FIG. 7.

Figure 8:
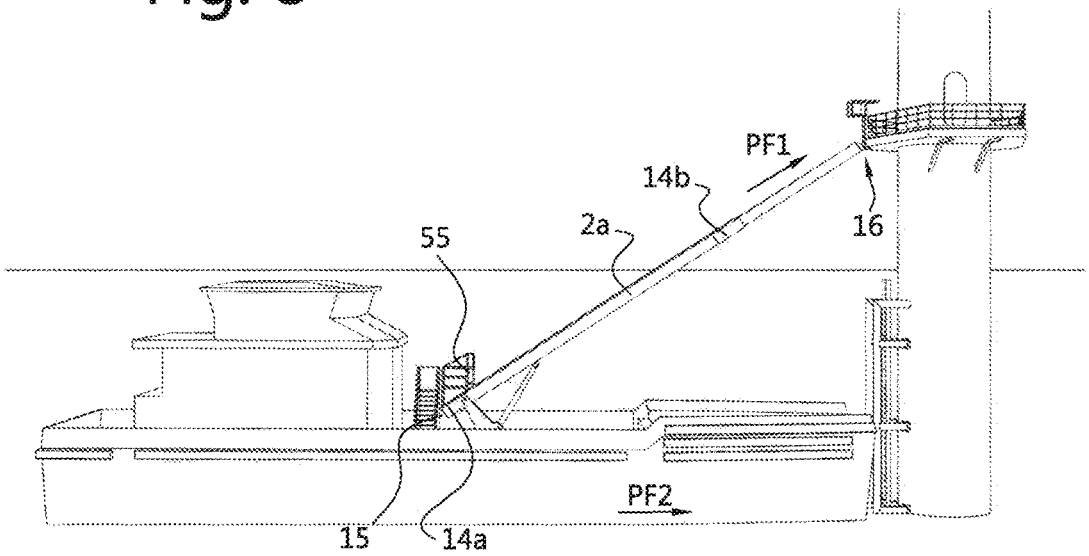

Simultaneously with the luffing and/or thereafter the beam assembly 2 can be further manoeuvred towards the landing provision 13 by telescopingly extending the beam assembly 2. This is continued until the distal outer end 16 has gotten to lie with a right-angled hook portion 52 against a lower corner edge 53 of the landing provision 13. This is shown in FIG. 8. The drive provisions with control means 10 can then again be operated to have the distal outer end 16 of the beam assembly 2 constantly exert the certain minimum pushing force PF1 against the lower corner edge 53 of the landing provision 12. This force here gets counteracted by the vessel 1 getting substantially kept in place by means of the pushing force PF2 against the bumpers 51. Thus also a permanent pre-tensioned contact can be obtained between the beam assembly 2 of the transfer installation and the landing provision 12 of the wind turbine 13, which pre-tension still makes it possible for the beam assembly 2 to retract and extend as soon as this is necessary for compensations of movements of the vessel 1 relative to the wind turbine 13, like up and down sliding movements with the waves along the bumpers 51 as well as heave, roll and pitch movements of the vessel 1.

In FIG. 8 it can also be seen that the first carriage part 14*a* now has a cage-like support 55 mounted on top of it. This assembly is ready and waiting at the proximal outer end 15 of the first beam element 2*a* for persons and cargo to take place or be placed on and in the support 55. Subsequently the first carriage part 14*a* can be moved along and over the first beam element 2*a*. With this four sets of upper and lower rollers 56 stably encompass sideways projecting flanges 57 of the guiding provisions. See also FIG. 9.

The second carriage part 14*b* like in the FIG. 1-4 embodiment is formed as a slideable sleeve organ that is equipped with a fully complementary cross-sectional shape as the first beam element 2*a* and that is slidable along and over the second beam element 2*b*.

As soon as the first carriage part 14*a* reaches this second carriage part 14*b* it rolls along until it gets to rest fully on top of it. In that position the four sets of upper and lower rollers 56 stably encompass sideways projecting flanges 57' of the second carriage 14*b*, while at a same time the first carriage part 14*a* gets blocked with its front side against a limitation wall 58 (see FIG. 16) that is provided at a front side of the second carriage part 14*b*.

Figure 9:
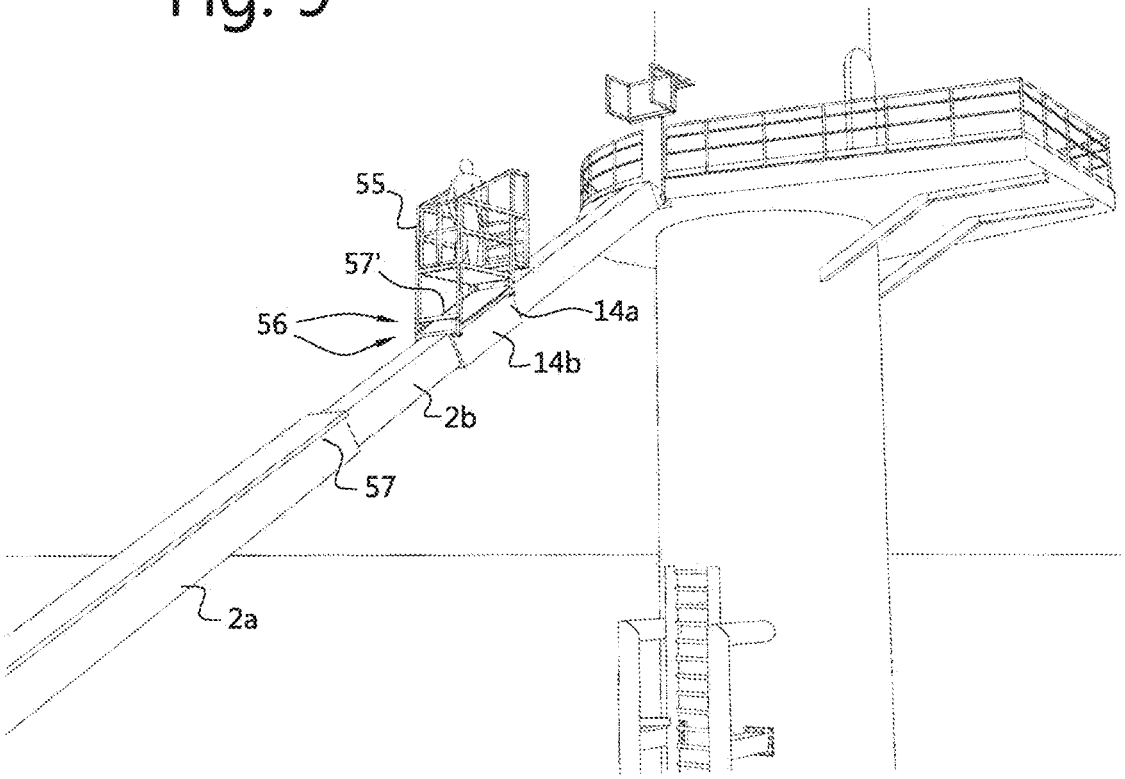
Figure 10:
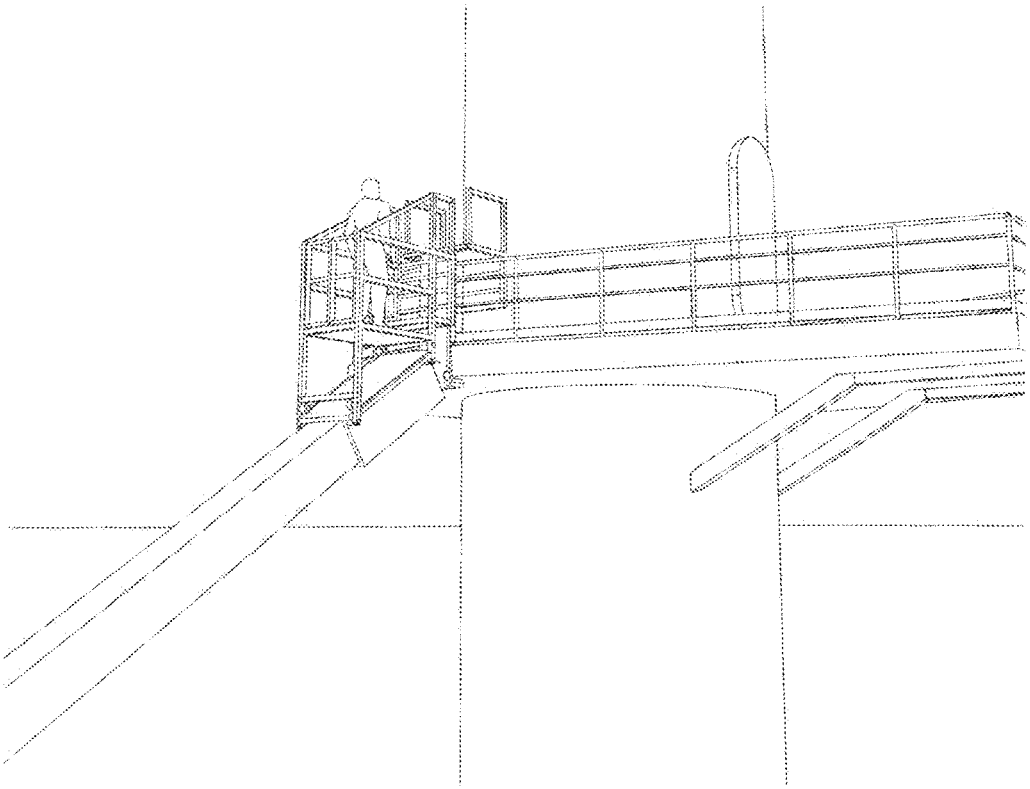

As can be seen in FIG. 9 a further moving forward of the first carriage part 14*a* then automatically results in the second carriage part 14*b* getting pulled along. This is continued until the thus assembled carriage 14 reaches the distal outer end 16. In that end position the cage-like support 55 lies proximate to or against a railing of the landing platform. The person then can easily step over from the support 55 onto the landing platform. See FIG. 10.

Figure 11:
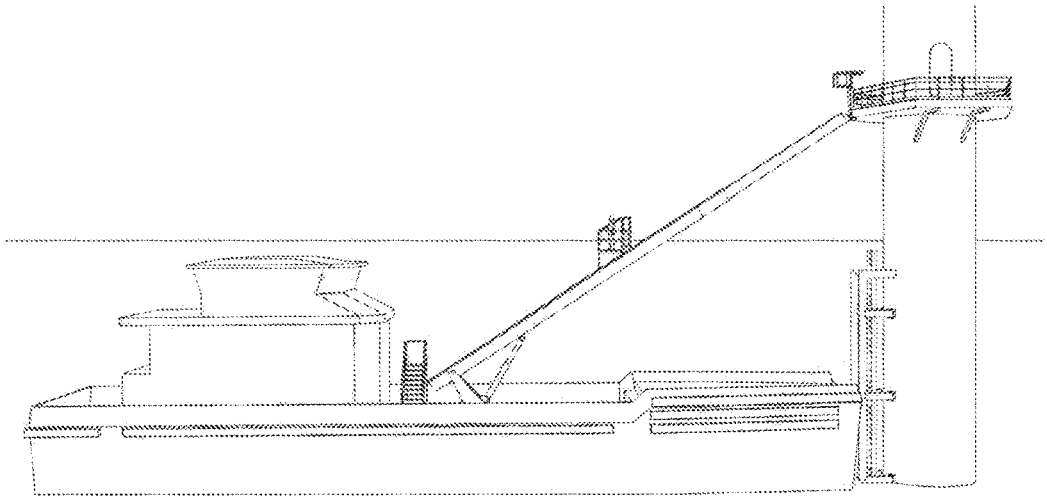

As soon as scheduled working activities on the wind turbine 13 are finished, the person can step back onto the support 55 again and be safely moved back along the beam assembly 2 towards the vessel 1 again. See FIG. 11. Subsequently the beam assembly 2 can be retracted and stored on the vessel's deck and the vessel 1 can sail away towards another offshore construction that needs to be visited for maintenance purposes or the like.

Figure 12:
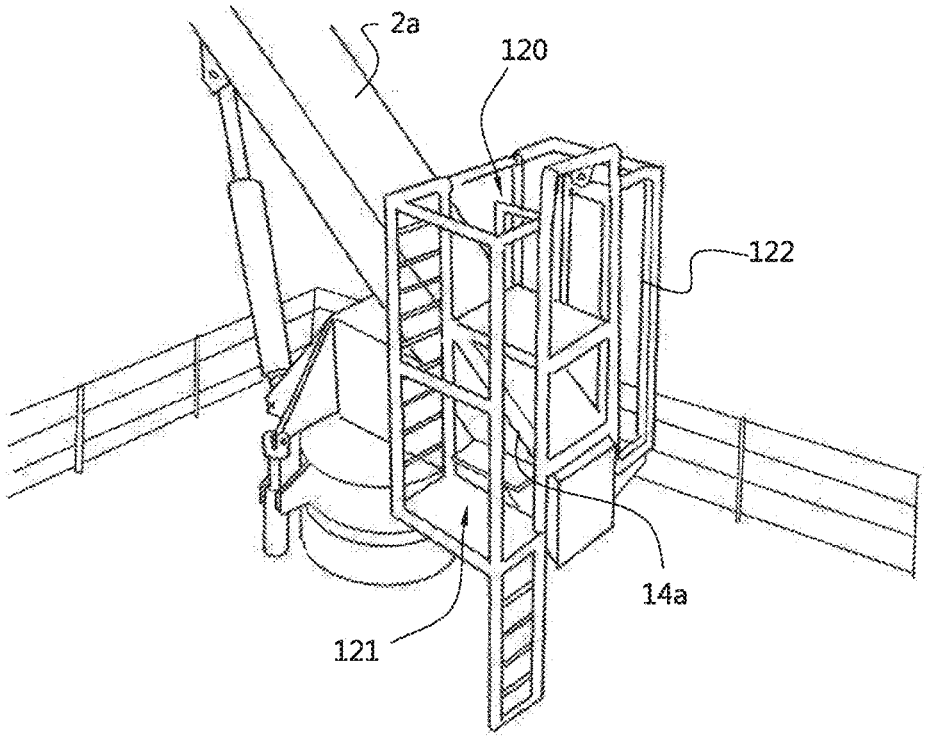
FIG. 12-15 show two other variants of the carriage with support.
Figure 13:
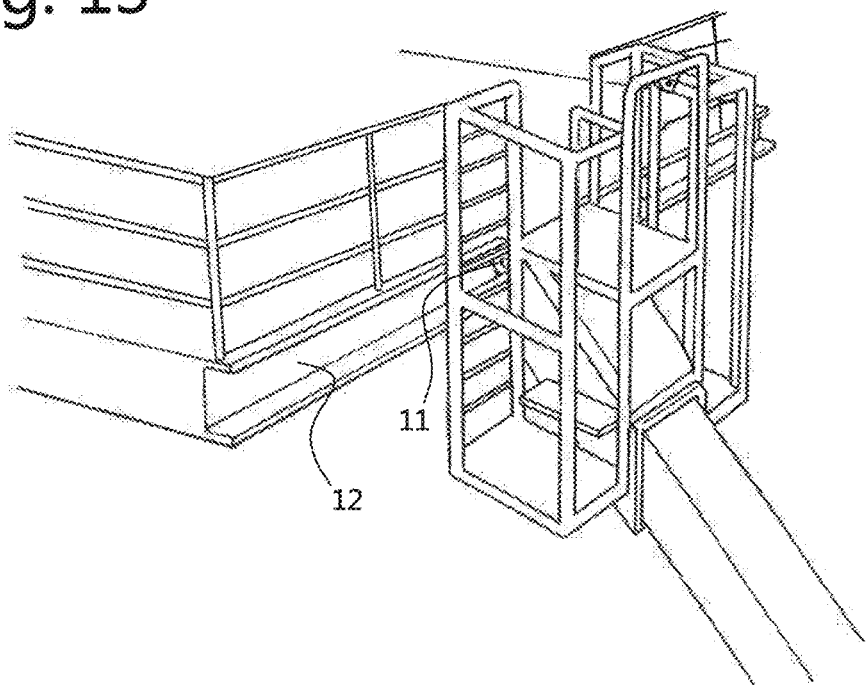

In FIGS. 12 and 13 a variant is shown of the cage-like support respectively in a lower and upper position along the beam assembly 2. Both of them are provided with a center support portion 120 that rests on top of the first carriage part 14*a* and side support portions 121, 122 that hang downwardly at opposing sides of the beam assembly 2. Thus it is advantageously possible to transport more than one person at a time along and over the beam assembly 2. In FIG. 13 it can be seen that the landing provision 12 here, like in the FIG. 1-4 embodiment, comprises a U-profile inside which the contact element 11 can fit with some play. The guiding provisions in this variant are formed by upper and lower surface portions of the first beam element 2*a* and of the second carriage element 14*b* along and against which upper and lower friction reducing guiding organs of the first carriage part 14*a* are guided.

Figure 14:
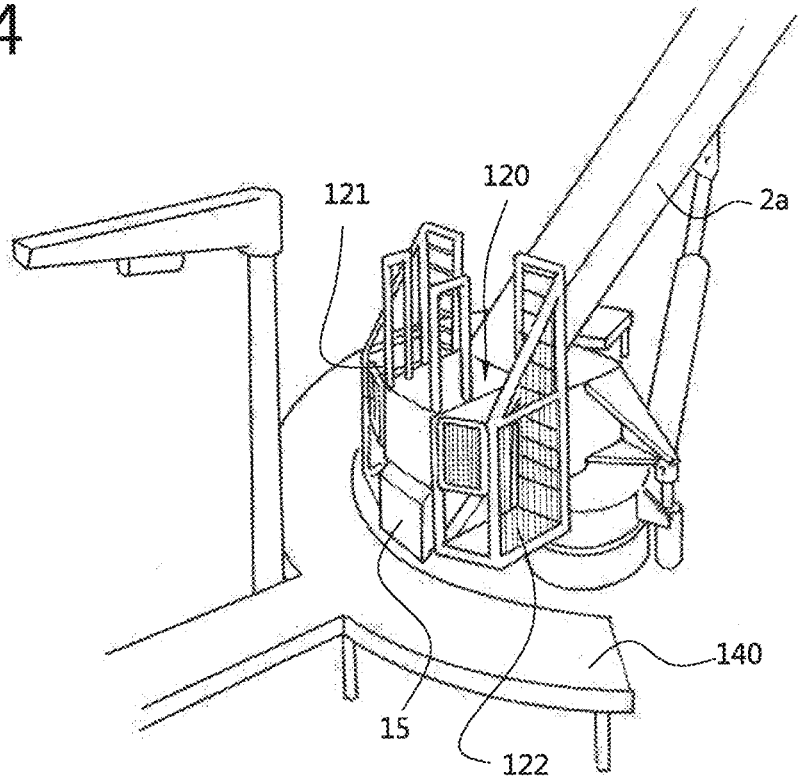
Figure 15:
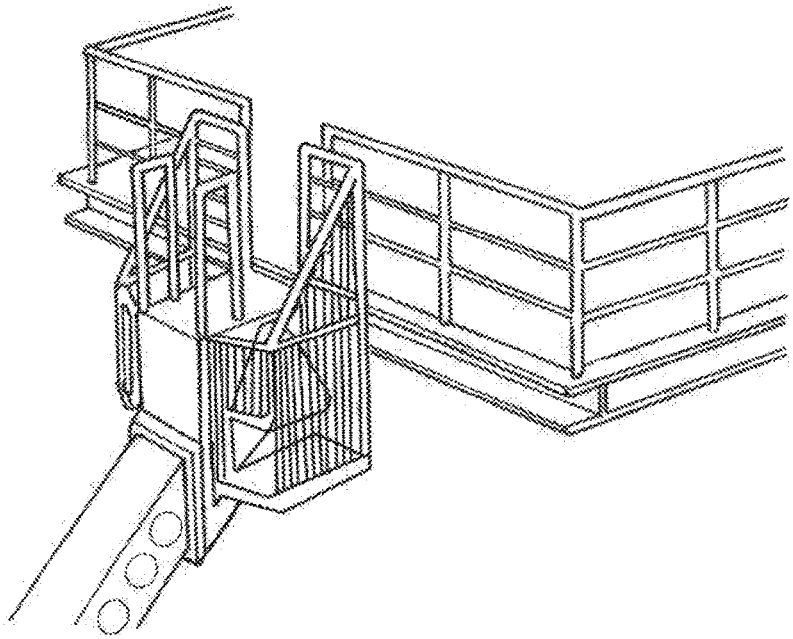

In FIGS. 14 and 15 a variant is shown which also is designed to offer space for more than one person and/or a plurality of cargo elements. In FIG. 14 it can be seen that at the position of the proximal outer end 15 of the beam assembly 2, a semi-circular platform 140 is provided which makes it possible for the carriage part 14*a* with its support portions 120-122 to easily be loaded and unloaded for various rotational positions of the beam assembly around its pedestal, that is to say around the z-axis.

Figure 16:
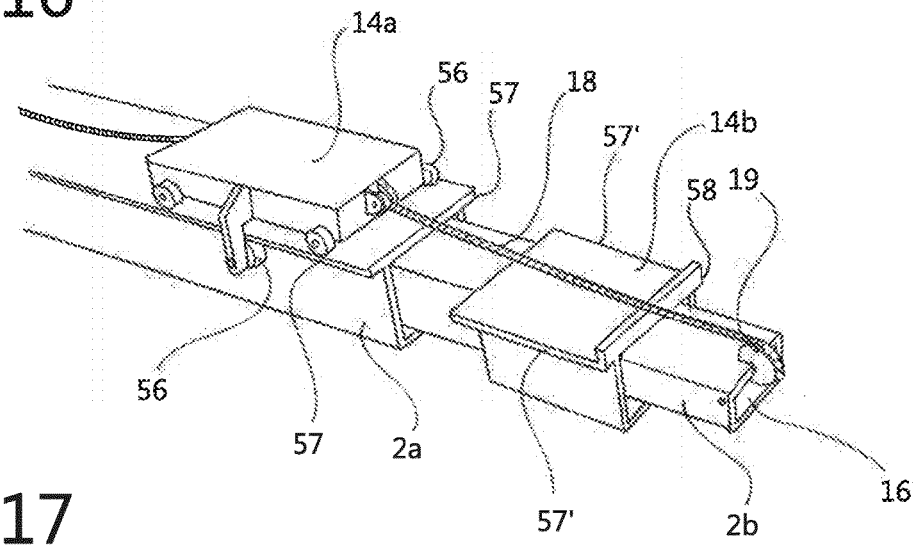
FIGS. 16, 17 and 18 show three variants of the driving device for moving the carriage along the beam elements.

FIG. 16 shows the second drive provisions with control means 10' for controlled movement of the first carriage part 14*a* over and along the beam assembly 2 in more detail. It can be seen there that the cable 18 is connected with one end to a front portion of the first carriage part 14*a* and with its outer end to a back portion of the first carriage part 14*a*. Furthermore the cable 18 is guided over the reverse pulley 19 at the distal outer end 16 as well as over the winch 17 at the proximal outer end 15. Driving of the winch 17, for example by means of an electromotor, in a clockwise direction then shall result in the first carriage part 14*a* getting pulled towards the distal outer end 16, whereas in a counter-clockwise direction then shall result in the first carriage part 14*a* getting pulled towards the proximal outer end 15.

Figure 17:
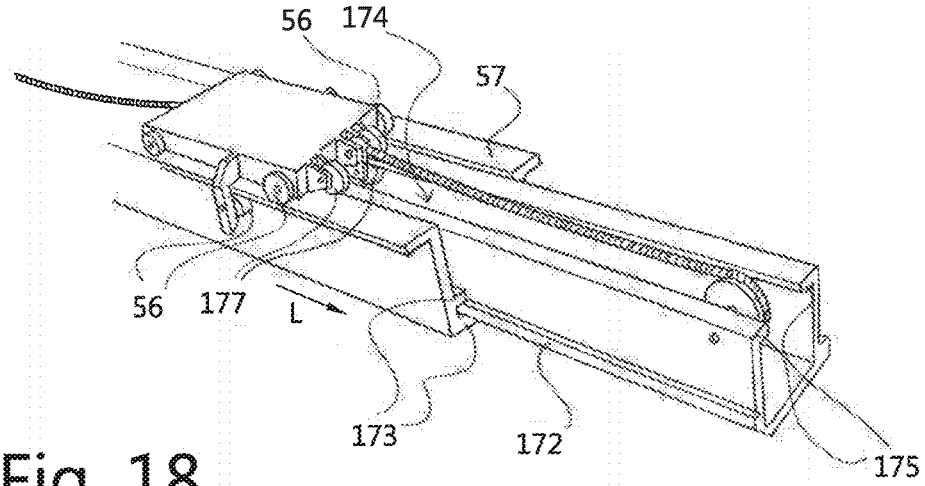

FIG. 17 shows a variant in which one and the same carriage 14 can be guided along and over both the beam elements 2*a*, 2*b*. The beam element 2*a* now is provided without an upper wall. At its upper side it however still comprises the two sideways projecting flanges 57 that still get encompassed by the primary sets of upper and lower rollers 56 for guiding the carriage 14 along and over the first beam element 2*a*. The second beam element 2*b* is guided inside the first beam element 2*a* to slide into and out of it in the longitudinal direction L. With this the second beam element 2*b* at its side walls is provided with outwardly projecting flange parts 172 that are slidably guided in between inwardly projecting flange parts 173 of the first beam element 2*a*. Furthermore the second beam element is provided with a central slit 174 that extends in the longitudinal direction L in its upper wall. This slit 174 is delimited by inwardly projecting flanges 175 of the upper wall. Secondary sets of upper and lower rollers 177 that are provided at central positions at the front and back sides of the carriage 14. Those secondary sets of upper and lower rollers 177 encompass the inwardly projecting flanges 175 of the second beam element 2*b* for guiding the carriage 14 along and over the second beam element 2*a*. Thus also a smooth bump free moving of the carriage 14 over and along the entire beam assembly 2 is possible, including at the possibly constantly displacing transition between the telescoping beam elements 2*a*, 2*b*.

Figure 18:
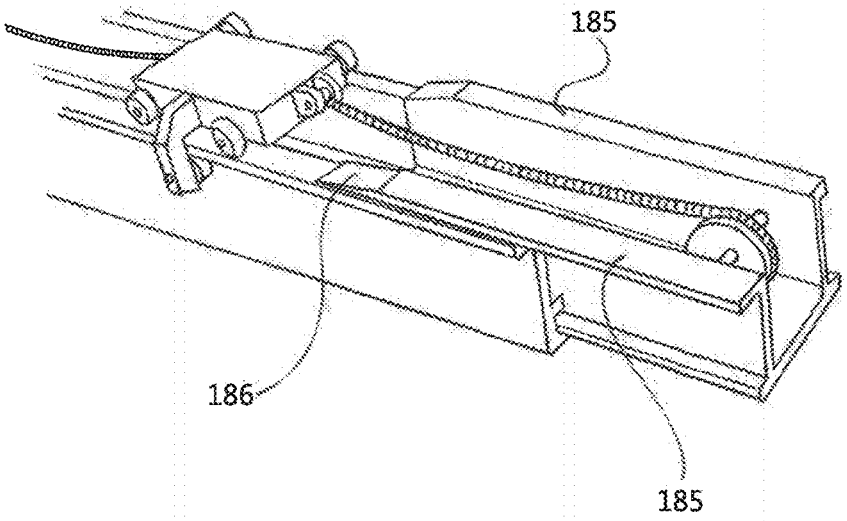

FIG. 18 shows a variant in which again one and the same carriage 14 can be guided along and over both the beam elements 2*a*, 2*b*, and this time with only primary sets of upper and lower rollers. The beam element 2*a* again is provided without an upper wall and at its upper side comprises the two sideways projecting flanges 57 that still get encompassed by the primary sets of upper and lower rollers 56 for guiding the carriage 14 along and over the first beam element 2*a*. The second beam element 2*b* here also is guided inside the first beam element 2*a* to slide into and out of it in the longitudinal direction L by means of the outwardly projecting flange parts 172 of the second beam element 2*b* sliding with a form fit inside the inwardly projecting flange parts 173 of the first beam element 2*a*. This time however the second beam element 2*b* is also provided without an upper wall and at its upper side merely comprises outwardly projecting flanges 185. The flanges 57 and 185 are dimensioned with same widths with the flanges 185 sliding on top of the flanges 57. The outwardly projecting flanges 185 thus are also encompassable by the primary sets of upper and lower rollers 56 for guiding the carriage 14 along and over the first beam element 2*a*. If desired the rollers 56 can be biased towards the flanges 57, 185. In order to here also provide for a smooth and substantially bump free moving of the carriage 14 over and along the entire beam assembly 2 the flanges 185 at their starting ends are shaped like gradually increasing ramps 186. Thus advantageously only primary sets of rollers 56 are necessary for guiding the one-part carriage 14 both along the first and second beam element 2*a*, 2*b*.

Besides the shown embodiments various variants are possible. For example other types of drive provisions are possible, like electromotors. It is also possible to have the support connected to the carriage in a fixed position that has the support substantially horizontally orientated for average angles of inclination of the beam assembly. This is for example possible for visiting offshore constructions that all have their landing provision at similar heights. It is however also possible to constantly measure the angle of inclination of the beam assembly and constantly have the position of the support relative to the carriage corrected correspondingly. Instead of having the beam assembly constantly exerting a pushing force against the landing provision as long as contact between them is desired, it is also possible to have the distal end of the beam assembly releasably coupled to the landing provision. As soon as this is done the beam assembly can be set free to rotate around its x-, y- and z-axles as well as to freely extend and retract in its longitudinal direction while keeping the vessel substantially in place for example by means of the dynamic positioning, anchoring, or landing/mooring against the offshore construction itself.

Thus the invention provides a user-friendly and truly lightweight transfer installation for installation on a vessel with which persons and cargo in one go can quickly and safely be transferred to and from all kinds of offshore constructions without any effort from those persons themselves during the transfer.

The invention claimed is:

1. Vessel (1) equipped with a transfer installation for the transport and transfer of cargo and persons towards an offshore construction (12), that in particular is founded to the bottom of the sea, comprising:

means for stabilizing its position at sea relative to the offshore construction (12);

a telescopically extendable beam assembly (2) that comprises two or more beam elements (2*a*, 2*b*), which along their longitudinal axis are telescopable such that a distance between their outer ends (15, 16) is variable, which beam assembly (2) with its one outer end (15) is rotatably connected to the vessel (1) by means of an axle system (7*a*, 8*a*, 9*a*); and a driving device designed to bring the other outer end (16) of the telescopically extendable beam assembly (2) in contact with a landing provision (13) of the offshore construction (12), characterized in that, the telescopically extendable beam assembly (2), which with its one side (15) is rotatably connected to the vessel (1) by means of the axle system (7*a*, 8*a*, 9*a*), is provided with means for moving a transportation carriage (14) back and forth between both outer ends (15, 16) along the telescopically extendable beam assembly (2), wherein the transportation carriage (14) is provided with a support (20) for carrying the cargo and persons.

2. Vessel according to claim 1, wherein the telescopically extendable beam assembly (2) is provided with drive means and control provisions for maintaining permanent contact with the offshore construction (12) independent of vessel movement.

3. Vessel according to claim 1, wherein the transportation carriage (14), which is movable back and forth between both outer ends (15, 16) of the telescopically extendable beam assembly (2), is dividable in at least two carriage parts (14*a*, 14*b*).

4. Vessel according to claim 3, wherein one of the carriage parts (14*a*, 14*b*) is provided with the support (20) for carrying the cargo and persons.

5. Vessel according to claim 3, wherein each of those carriage parts (14*a* 14*b*) is specifically designed for moving in the longitudinal direction along a respective one of the beam elements (2*a*, 2*b*) that is specifically destined for this respective carriage part (14*a*, 14*b*).

6. Vessel according to claim 3, wherein the one carriage part (14*a*) is movably guided along the one beam element (2*a*) onto and connectable with the other carriage part (14*b*), and wherein the other carriage part (14*b*) is movably guided along the other beam element (2*b*).

7. Vessel according to claim 3, wherein the one carriage part (14*a*) is connectable with the other carriage part (14*b*).

8. Vessel according to claim 3, wherein a transition between the first and second beam elements (2*a*, 2*b*) forms a stop for one of the carriage parts (14*b*) to move towards the one end (15) of the beam assembly (2).

9. Vessel according to claim 3, wherein the drive system (17, 18, 19) connects to the one carriage part (14*a*), for bringing the one carriage part (14*a*) from the one outer end (15) forth towards, onto and in connection with the other carriage part (14*b*), and for then bringing the carriage parts (14*a*, 14*b*) together as an assembly further forth towards the other outer end (16).

10. Vessel according to claim 1, wherein the means for moving the transportation carriage (14) back and forth between both outer ends (15, 16) of the telescopically extendable beam assembly (2) comprise a drive system (17, 18, 19), in particular one having a winch (17), cable (18) and reverse pulley (19).

11. Vessel according to claim 1, wherein the axle system (7*a*, 8*a*, 9*a*), via which the telescopically extendable beam assembly (2) is connected one-sided with the vessel construction, comprises drive means and control means (7*a*, 8*a*, 9*a*) for controlling rotations around the individual axles (7*a*, 8*a*, 9*a*).

12. Vessel according to claim 1, wherein the transportation carriage (14) comprises means (21) for adjusting the support (20) for carrying the cargo and persons with the aim of having it adjusted in an aimed angle relative to the beam assembly (2), and in particular independent of an angle of orientation of the telescopically extendable beam assembly (2).

13. Vessel according to claim 1, wherein the transportation carriage (14) is guided along the beam assembly (2) by means of rollers (56), in particular sets of upper and lower rollers (56) that encompass flanges (57) of the beam assembly (2).

14. Method for transferring or taking over persons and cargo from or towards an offshore construction from a vessel according to claim 1, comprising the steps:

stabilizing the vessel (1) in a position at sea relative to the offshore construction (12); and bringing the other outer end (16) of the telescopically extendable beam assembly (2) in contact with the landing provision (13) of the offshore construction (12); and maintaining this contact by having the beam assembly (2) telescopically extend and rotate around the axle system (7*a*, 8*a*, 9*a*) for compensating relative movements between the vessel (1) and the offshore construction (12), characterized in that, the method further comprises the step:

moving the transportation carriage (14) back and forth between both outer ends (15, 16) along the telescopically extendable beam assembly (2).

15. Method according to claim 14, wherein during the step of moving the transportation carriage (14) forth from the one outer end (15) towards the other outer end (16), the one carriage part (14*a*) of the transportation carriage (14) is moved forth along the one beam element (2*a*), then connected with the other carriage part (14*b*) of the transportation carriage (14), and then together as an assembly further forth along the other beam element (2*b*) towards the other outer end (16), and wherein during the step of moving the transportation carriage (14) back from the other outer end (16) towards the one outer end (15), the one carriage part (14*a*) is moved back together as an assembly with the other carriage part (14*a*) along the other beam element (2*a*), then disconnected from the other carriage part (14*b*) onto the one beam element (2*a*), and then alone further back along the one beam element (2*a*) towards the one outer end (15).

* * * * *